United States Patent [19]

Gloor

[11] Patent Number: 4,913,219

[45] Date of Patent: Apr. 3, 1990

[54] PROCESS AND DEVICE FOR CASTING THIN STRIP OR FOIL FROM THE MELT

[76] Inventor: Hans Gloor, Sandbockstrasse 19, Umiken, Switzerland, CH-5222

[21] Appl. No.: 246,665

[22] PCT Filed: Sep. 29, 1987

[86] PCT No.: PCT/CH87/00126

§ 371 Date: Jul. 28, 1988

§ 102(e) Date: Jul. 28, 1988

[87] PCT Pub. No.: WO88/02288

PCT Pub. Date: Apr. 7, 1988

[30] Foreign Application Priority Data

Sep. 30, 1986 [CH] Switzerland ..... 3932/86

[51] Int. Cl.[4] ..... B22D 11/06

[52] U.S. Cl. ..... 164/463; 164/423; 164/429; 164/479

[58] Field of Search ..... 164/463, 423, 429, 479

[56] References Cited

U.S. PATENT DOCUMENTS

| | | | |
|---|---|---|---|
| 4,271,257 | 9/1980 | Narasimhan | 164/463 |
| 4,566,525 | 1/1986 | Li et al. | 164/463 |

FOREIGN PATENT DOCUMENTS

| | | | |
|---|---|---|---|
| 3411466 | 10/1984 | Fed. Rep. of Germany | 164/423 |
| 57-64452 | 4/1982 | Japan | 164/423 |
| 58-29555 | 2/1983 | Japan | 164/423 |

*Primary Examiner*—Kuang Y. Lin

*Attorney, Agent, or Firm*—Roylance, Abrams, Berdo & Goodman

[57] ABSTRACT

In a process for casting strip and foil, a melt from a casting slit (4) of a casting nozzle (3) is applied to a moving cooling body (6). The melt is thereby diverted in a gap (A) from the flow-out direction out of the casting slit into the strip removal direction. In order to improve the casting conditions and the strip quality, but also to be able to produce larger cast formats, especially a multiplication of the produceable strip width and a simplification and cheapening of the melt feed device to the cooling body, the melt is fed in the casting nozzle (3) up as far as the entry into the casting slit (4) perpendicular to the casting direction and perpendicular to the strip removal direction (21). In the region of the casting slit within the casting nozzle, a diversion of the melt into the flow-out direction is provided for.

27 Claims, 4 Drawing Sheets

PROCESS AND DEVICE FOR CASTING THIN STRIP OR FOIL FROM THE MELT

The invention is concerned with a process for casting and a casting device for strip and foil from metal or metal oxide melts.

A considerable fraction of industrially used metal or metal oxide sheet is required in the form of thin sheet or foil. There is hence a notable effort directed to processes and devices for the direct fabrication of such thin sheet or foil by avoiding traditional casting and rolling techniques. As recent efforts in this direction have shown, thin metal or metal oxide strip and foil may be produced directly from the melt, whereby on the one hand considerable energy saving can be effected as compared with conventional processes, and on the other hand properties can be obtained in the product which cannot be realized with conventional casting processes. Sheet and foil with amorphous, nano/microcrystalline structure or even a combined structure, e.g. amorphous in certain regions and crystalline in others, can only be fabricated with the newly developed process or device.

For instance, processes and devices are known for directly casting metal melts onto moving cooling bodies, whereby usually a cooling drum or a moving cooling belt are employed. The metal melt is thereby cast onto the surface of the cooling drum or belt through a nozzle-like applicator element. The most important process parameters for the casting process are the velocity of the movement of the surface of the cooling body relative to the casting nozzle, the heat conduction from the strip to the cooling body and the further important parameter of the nozzle geometry.

Together with the gap between the nozzle and the surface of the cooling body, the width of the casting slit in the casting device is also of decisive influence on the casting process. The geometry of the casting slit was also considered to be of considerable importance in the previous development. Efforts to improve the casting process have thus also been directed to the shaping and sizing of the nozzle aperture and the gap between the nozzle aperture and the surface of the cooling body. Common to nearly all known suggestions is that the metal melt flows under gravity from a melt vessel into the nozzle and the casting slit. This gravity-dependent flow of the metal to the nozzle was at most assisted in the modern strip casting technique by a controllable pressure system. For this reason, considerable restrictions had to be observed on sizing the nozzle aperture and the region between nozzle aperture and the surface of the cooling body in order to secure perfect casting and to prevent an uncontrolled run-out or freezing of the melt at the casting slit before the actual casting operation.

From the DE-OS 3 411 466, for example, a process is known for the fabrication of thin metal strip, in which the application angle between the flow direction of the melt leaving the nozzle and the casting surface is reported to lie between 20 and 80 degrees. According to DE-OS 3 442 009, a nozzle configuration for casting thicker strip was suggested in which several nozzle slits are arranged in a row in the casting direction. By this means, thicker strip should result from sequential multiple applications of the melt when the separation of the nozzle slits from each other and the width of the nozzle slits are suitable.

It is the aim of the present invention to create a process and a device for casting strip or foil from metal or metal oxide melts which lead to cast products with improved quality and to a simpler and cheaper device for melt application to the cooling body. Furthermore, the melt application device shall permit the fabrication of larger cast formats, especially a multiplication of the width of the strip which can be produced.

This aim is fulfilled according to this patent by the sum of the features in the patent claims 1 and 5.

Despite the lateral melt feed according to the invention, cast products may be produced with excellent surface quality and of unusually uniform thickness, also in the edge regions. As a result of the relatively simple and robust design of the nozzle, the casting process may be controlled very precisely and reliably. Because the melt is fed laterally, the intermediate vessel may be situated above or below the casting nozzle. This results in ideal conditions at the beginning of casting and at the same time a long casting duration can be assured. With the new process and nozzle device, not only thicker strip may be produced: by extension of the nozzle pipe of the metal supply system, strip with a width many times that of the state of the art may be fabricated. The nozzle itself is of simple construction and the sizing of the casting slit can, in contrast to the state of the art, be more freely carried out.

The melt may be fed to the casting nozzle by gravity, whereby the static pressure can be kept constant by a level control in the intermediate vessel. By means of a flow control device in the intermediate vessel, the beginning of casting may be determined. According to one embodiment, it is specially advantageous when the melt is pressed up into the casting nozzle by means of gas pressure from a level of the bath liquid surface in the casting or intermediate vessel below the casting nozzle. The casting slit in this solution remains untouched until the beginning of casting.

The feed flow speed of the melt into the casting nozzle is specially related to the cross-section of the strip produced. For strip with a thickness below 0.3 mm, it is advisable to set the feed flow speed of the melt in the tubular nozzle body in front of the region of the casting slit to a maximum of 2 m/sec., preferably to a maximum of 0.8 m/sec. The cross-section of the tubular casting nozzle can be oval, rectangular, polygonal, etc. An advantageous fabrication and a low flow resistance is assured, when the tubular casting nozzle has a circular cross-section.

Together with the width of the casting slit of the casting nozzle, the design of the casting nozzle surface in the region of the direction change and freezing of the melt is of importance. According to a further embodiment, it is recommended to flatten the external tube housing surface in the region of the casting slit with a circular nozzle cross-section.

Feeding of the melt into the casting nozzle from one side can be designed fundamentally in various different forms. An especially favorable embodiment is an L-shaped tube body for the casting nozzle, one of whose arms is immersed in the melt bath and which is separated from the melt vessel as a casting feed system part.

Instead of the L-shaped tube body, a U-shaped tube body can also be imagined which possesses a casting slit in the middle connecting tube, and each of whose parallel arms is immersed in a melt vessel.

For various reasons, it can be desirable to arrange for the metal feed onto the cooling body to be irregular along the casting slit by means of varying slit widths. The slit width can, for instance, converge in the flow direction, etc. Here, we are thinking especially about the fabrication of strip with predetermined, amorphous and/or crstalline structure, surface structure, strip thickness, etc, which in each case may be the same or differing across the width of the strip.

A melt feed free of disturbances through the casting slit onto the cooling body is of great importance for the quality of the strip produced. Especially with strip with a thickness of the order of 0.01–0.3 mm, quality problems arise, especially with strip wider than 80 mm. According to a further embodiment, it is suggested that the width of the casting slit should amount to 20 to 50 times, preferably 20 to 30 times the desired thickness of the strip to be cast. The separation gap between the casting nozzle and the moving cooling body can be 0.05–0.5 mm, preferably 0.1–0.2 mm.

An uniform strip quality at the beginning of casting can be attained when a rapid equilibrium of the casting parameters can be set up. In one of the embodiments, it is recommended to provide a casting slit only along part of the length of the tubular casting nozzle, opposite the feed side, the tube possessing a cover part containing a ventilation hole.

According to the method of metal feeding to the casting nozzle, e.g. by gravity, gas pressure or other control arrangement, the position of the casting nozzle along the, at least partially, curved cooling body or the angle of the cooling body surface to the horizontal at a first contact point between the melt and the cooling body after leaving the nozzle may be selected. Apart from the method of feeding the melt to the nozzle, however, further casting parameters such as strip thickness, composition of the melt and the resulting physical properties such as viscosity, surface tension, etc. are determining for the position of the casting nozzle relative to the angular position of the cooling body surface. The angle of diversion of the melt between the exit direction in the casting slit and the strip removal direction can also be preset. This diversion angle can, for example, amount to between 30 and 120 degrees, preferably between 60 and 100 degrees. Both the position of the casting nozzle relative to the angular position of the cooling body surface and the diversion angle of the melt may be adapted to the casting parameters and the product in an optimum way.

In the following, the invention will be more closely described with reference to preferred embodiments with the aid of the drawings.

Figure 1:
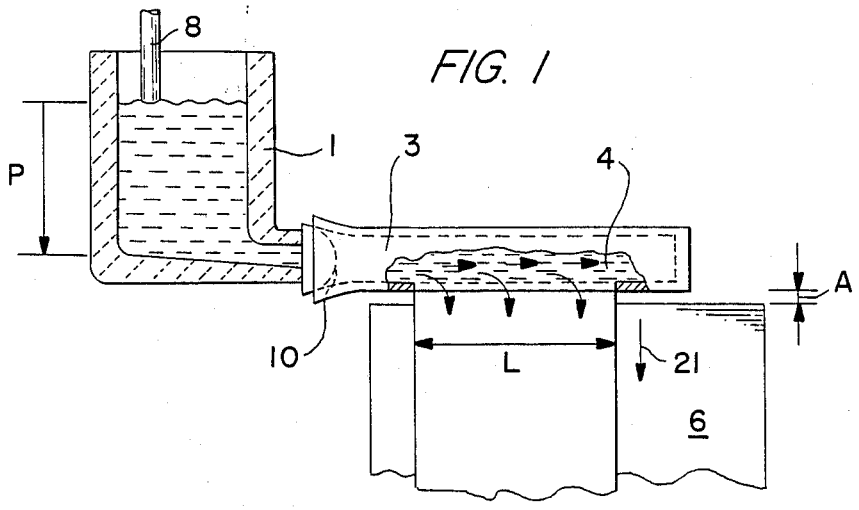
FIG. 1 shows a side view, partly in section, of a casting device with a nozzle separable from the casting vessel.

In FIG. 1 a casting device for strip or foil from metal or metal oxide melts is illustrated schematically. A rotating drum is employed for the moving cooling body 6. A casting nozzle 3 is arranged at a certain distance A from the casting surface of the cooling body 6. The casting nozzle 3 is equipped with a lateral melt feed from a casting vessel 1, also known as an intermediate vessel, which itself can be supplied by a casting jet 8 from a reservoir. The casting nozzle 3 is further provided with a casting slit 4, said slit being axially oriented in its length L to the casting nozzle 3 and essentially perpendicular to the direction of movement 21 of the surface of the cooling body 6. The length L of the casting slit corresponds to the strip width to be cast. Between the exit direction of the melt in the casting slit 4 and the direction of movement 21, also known as the strip removal direction, a diversion of the melt occurs in the gap A, as shown in detail in FIGS. 7 and 8.

The casting nozzle possesses in this example an essentially circular, tubular cross-section. The melt feed from one side is connected with a connector 10 to the casting nozzle 3.

Figure 2:
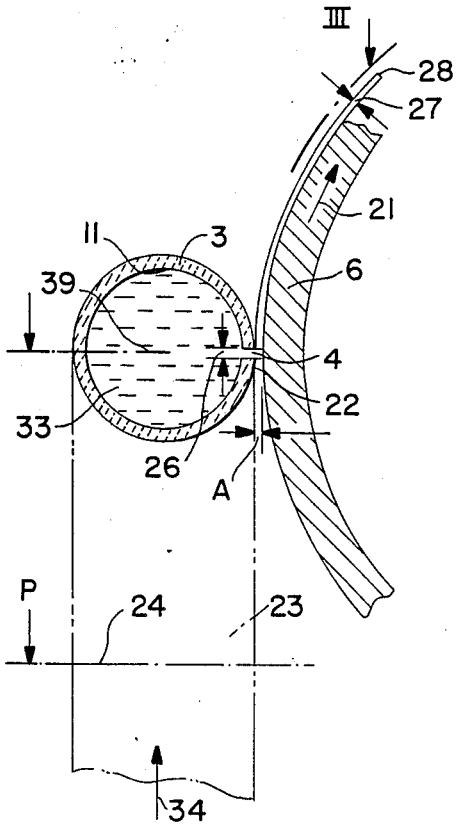
FIG. 2 shows a vertical section through a second embodiment with a nozzle slit directed from one side onto a casting drum.
Figure 3:
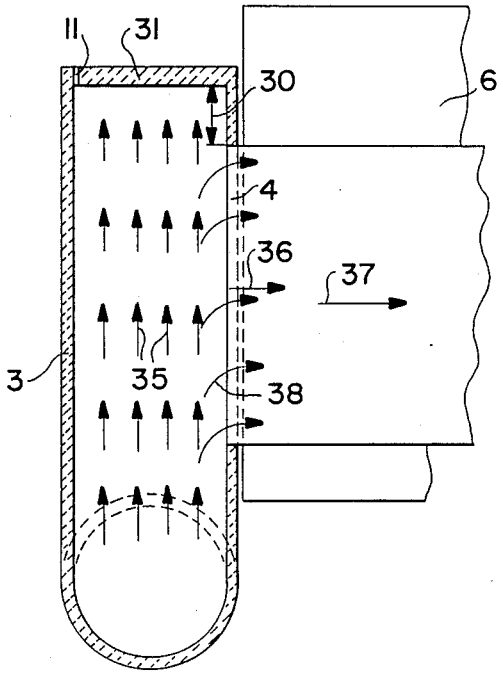
FIG. 3 shows a plan view, partly in section, along III—III of FIG. 2.

In FIGS. 2 and 3, corresponding parts are marked with the same reference numbers. An outer tube wall surface 22 in the region of the casting slit 4 is flattened in order to lengthen the gap A in the direction of movement 21 of the cooling body 6. For a casting nozzle 3 in this example, an L-shaped tube body with a right angle is employed. The vertical tube part 23 in FIG. 2, which is drawn with dots and dashes, and which lies in front of the section, is immersed in a plane 24 into the melt bath of a pressure-tight casting vessel. By means of a pressure P on the melt bath, the melt may be pressed from the casting vessel into the casting nozzle 3.

The width 26 of the casting slit 4 can, depending on the chosen casting parameters and the product, be between 20 and 50 times, preferably between 20 and 30 times the planned thickness 27 of the cast strip 28. The gap A between the surface 22 of the casting nozzle and the moving cooling body 6 can be between 0.05 and 0.5 mm, for a thin strip preferably between 0.1 and 0.2 mm.

As can be most clearly seen in FIG. 3, the casting slit 4 ends at a distance 30 from the tube closure cap 31. The length of the casting slit 4 is thus only a fraction of the length of the tubular casting nozzle 3. The closure cover 31 attached opposite the feed side is provided with a ventilation hole 11, from which the air can be allowed to escape in a controlled manner upon starting up casting.

Figure 4:
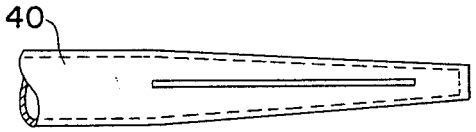
FIGS. 4 and 5 shows side views of the casting nozzles.
Figure 5:
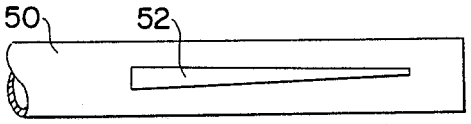

In FIGS. 4 and 5 embodiments of casting nozzles 40 and 50 are illustrated, whereby the casting nozzle 40 becomes narrower in the direction of melt feed. In the case of nozzle 50, the width of the casting slit converges in the direction of melt feed.

The features of the process will now be explained with the aid of FIGS. 2 and 3. By means of the pressure P on the metal surface in the plane 24 below the casting nozzle 3, the melt 33, as shown by the arrow 34, is pressed up through the vertical tube part 23 into the casting nozzle 3. The melt 33 is fed as far as the entry to the casting slit 4 essentially axially to the tubular casting nozzle 3 (arrow 35), or in other words perpendicularly to the flow-out direction (arrow 36) in the casting slit. The feed direction 35 is simultaneously also perpendicular to the strip removal direction 37. In the flow-in region of the casting slit and in the casting slit 4 itself, a diversion of the melt according to the arrows 38 from the metal feed direction 35 into the flow-out direction 36 is provided for. In the gap A between the casting nozzle 3 and the surface of the cooling body 6, the melt 33 emerging from the casting slit 4 is diverted from the flow-out direction 36 in the casting slit 4 into the strip removal direction 37. Freezing of the strip occurs essentially in the gap A by heat removal via the moving cooling body 6 from one side of the strip.

A pressure calculated under static (not dynamic) conditions on the melt in a plane 39 of the casting slit 4 during the casting operation is set up to be 0.1–0.2 bar. In the tubular casting nozzle 3, the feed velocity of the melt in front of the region of the casting slit 4 should be limited to 2 m/sec., preferably to 0.8 m/sec.

Figure 7:
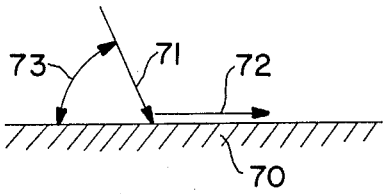
FIGS. 7 and 8 show schematics of the melt diversion upon impinging on various different cooling bodies.
Figure 8:
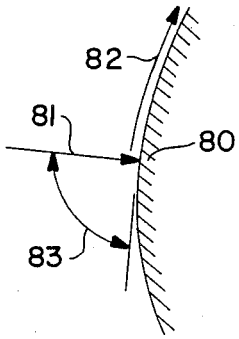

In the FIGS. 7 and 8, two further examples with differing angular positions of the cooling body surface in the region of the casting slit are explained schematically. A flat and a curved part of a belt or drum-shaped cooling body are illustrated with reference numbers 70 and 80. A flow-out direction 71 from a casting slit of a casting nozzle is diverted by an acute angle 73, e.g. between 60–89 degrees, into the strip removal direction 72. A first cooling path after the casting slit lies horizontally in this example.

In FIG. 8, a melt is diverted from a flow-out direction 81 from a casting nozzle into a curved strip removal direction 82 by a right angle 83. A first cooling path after the casting slit is in this example rising and curved. If desired, the initial cooling path can also be arranged on a falling angular position of the cooling body surface.

Figure 6B:
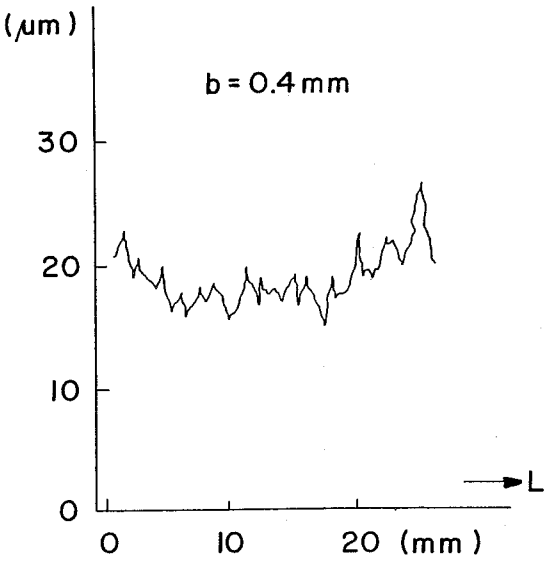
FIGS. 6A and 6B show diagrams of thickness measurements for a foil fabricated according to the invention and for a conventionally produced foil.
Figure 6A:
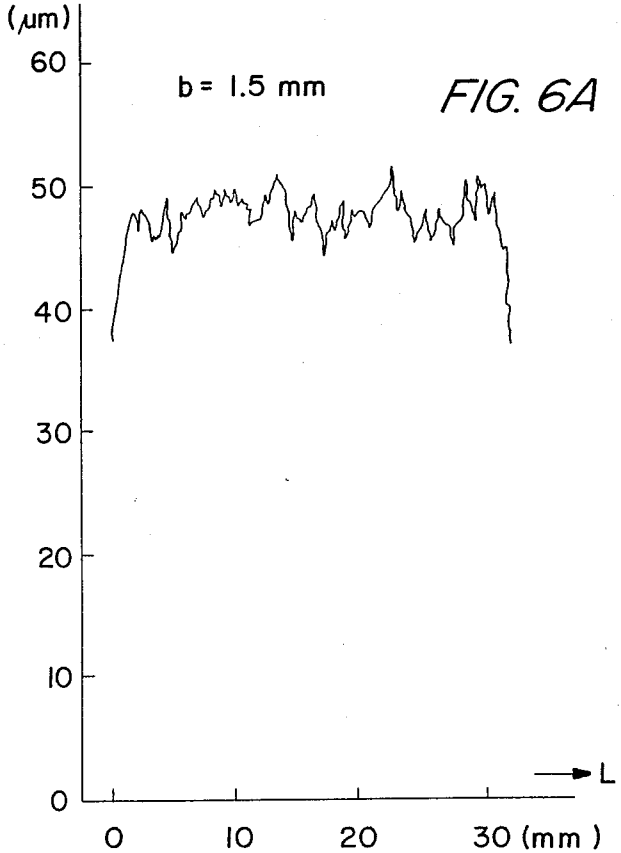
Figure 9:
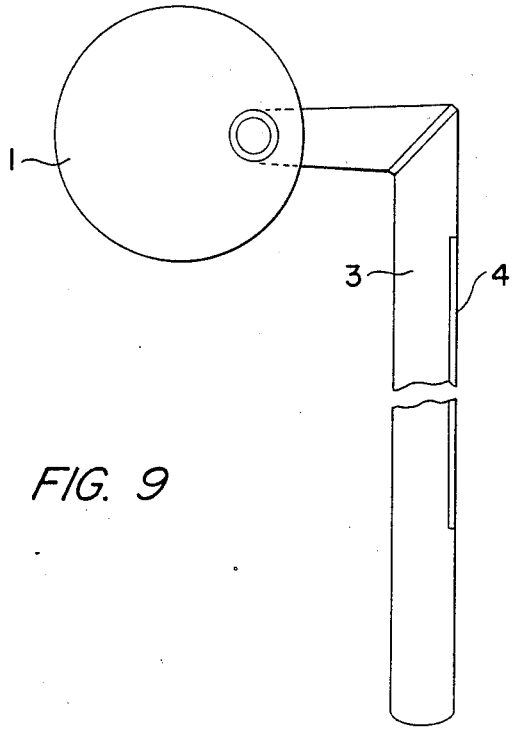
FIG. 9 is a plan view of the casting device of FIG. 1.
Figure 10:
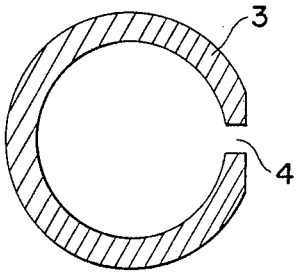
FIG. 10 is a transverse cross-sectional view of the casting nozzle.

As products of the casting operation, strip and foil result with a thickness which is adjustable to a considerable extent and is extremely uniform. The uniform thickness of the strip or foil produced may be proved by measurement. In FIG. 6A, a measurement curve of material thickness across the slit length is shown for a product made according to this invention. In FIG. 6B, the corresponding curve is shown for a reference product made by a well-known process. In the case of the process according to this invention, a tubular nozzle with an internal diameter of 15 mm with casting slit width of 1.5 mm was employed. In the reference process, the casting slit width was only 0.4 mm. The casting speed in both processes was 25 m/sec. The melt speed in the tubular nozzle in front of the region of the casting slit was calculated to be 0.424 m/sec., for a melt density of 6.7 kg/dm3. Although the strips were only 30 mm wide, it can be seen unequivocally that the strip made by the process according to this invention in FIG. 6A has a substantially more uniform thickness than the strip in FIG. 6B, which was made by the well-known process.

The casting nozzle is usually made of high quality refractory materials, such as $SiO_2$ glass, quartz, etc. It is of special interest to keep the tubular casting nozzle cross-section small, in order to obtain favorable production costs. For a clear cross-sectional area of the nozzle tube of 180–250 mm$^2$, for example, strip of 100 mm width may be produced, for example. From this one may calculate a ratio $$\frac{\text{Strip width in mm}}{\text{Clear flow cross-section in mm2}} =$$

-continued $$\frac{100\text{ mm}}{150\text{–}250\text{ mm2}} = \frac{1}{1.5 - 2.5\text{ mm}}$$

As a guidance in practice, one may therefore choose the clear nozzle tube cross-section in mm$^2$ to be one to three times the strip width.

I claim:

1. An apparatus for casting strip or foil from metal or metal oxide melts, comprising:

a cooling body moving in a first direction and having a casting surface; and an essentially tubular casting nozzle located at a certain separation from said casting surface, said casting nozzle including a tube wall, a casting slit extending axially in said tube wall, and a lateral feed portion with means for coupling said casting nozzle to a reservoir of casting material melt and for feeding the casting material melt in a feed direction generally perpendicular to said first direction, said casting slit having a length substantially perpendicular to said first direction and corresponding to a strip width to be cast, said slit having a width converging in the feed direction along the length;

whereby the melt exits said casting slit in a flow-out direction and is diverted at a diversion angle to a strip removal direction.

2. An apparatus according to claim 1 wherein said tubular casting nozzle possesses a circular cross-section.

3. An apparatus according to claim 2 wherein said casting nozzle comprises outer tube wall surface flattened adjacent said casting slit.

4. An apparatus according to claim 1 wherein said casting nozzle comprises an L-shaped tube body.

5. An apparatus according to claim 1 wherein the width of said casting slit is 20 to 50 times a desired thickness of the strip to be cast.

6. An apparatus according to claim 5 wherein the width of said casting slit is 20 to 30 times the desired thickness of the strip to be cast.

7. An apparatus according to claim 1 wherein said separation is 0.05–0.5 mm.

8. An apparatus according to claim 7 wherein said separation is 0.1–0.2 mm.

9. An apparatus according to claim 1 wherein said casting nozzle is positioned relative to said cooling body that an initial cooling path after said casting slit lies essentially horizontal.

10. An apparatus according to claim 1 wherein said casting nozzle is positioned relative to said cooling body that an initial cooling path after said casting slit is rising.

11. An apparatus according to claim 1 wherein the diversion angle of the melt between the flow-out direction in said casting slit and the strip removal direction lies between 30 and 120 degrees.

12. An apparatus according to claim 11 wherein the diversion angle is between 60 and 100 degrees.

13. An apparatus for casting strip or foil from metal or metal oxide melts, comprising:

a cooling body moving in a first direction and having a casting surface; and an essentially tubular casting nozzle located at a certain separation from said casting surface, said casting nozzle including a tube wall, a casting slit extending axially in said tube wall and a lateral feed portion with means for coupling said casting nozzle to a reservoir of casting material melt and for feeding the casting material melt in a feed direction generally perpendicular to said first direction, said casting slit having a length substantially perpendicular to said first direction and corresponding to a strip width to be cast, the inside diameter of said tubular casting nozzle tapering in the feed direction of the casting material melt;

whereby the melt exists said casting slit in a flow-out direction and is diverted at a diversion angle to a strip removal direction.

14. An apparatus according to claim 13 wherein said tubular casting nozzle possesses a circular cross section.

15. An apparatus according to claim 14 wherein said casting nozzle comprises outer tube wall surface flattened adjacent said casting slit.

16. An apparatus according to claim 13 wherein said casting nozzle comprises an L-shaped tube body.

17. An apparatus according to claim 13 wherein said casting slit has a width 20 to 50 times a desired thickness of strip to be cast.

18. An apparatus according to claim 17 wherein the width of said casting slit is 20 to 30 times the desired thickness of the strip to be cast.

19. An apparatus according to claim 13 wherein said separation is 0.05–0.5 mm.

20. An apparatus according to claim 19 wherein said separation is 0.1–0.2 mm.

21. An apparatus according to claim 13 wherein said casting nozzle is positioned relative to said cooling body that an initial cooling path after said casting slit lies essentially horizontal.

22. An apparatus according to claim 13 wherein said casting nozzle is positioned relative to said cooling body that an initial cooling path after said casting slit is rising.

23. An apparatus according to claim 13 wherein the diversion angle of the melt between the flow-out direction in said casting slit and the strip removal direction lies between 30 and 120 degrees.

24. An apparatus according to claim 23 wherein the diversion angle is between 60 and 100 degrees.

25. A process for casting strip and foil from metal or metal oxide melts, comprising the steps of:

applying melt from a casting slit of a casting nozzle in a flow-out direction onto a casting surface of a moving cooling body;

diverting the melt in a gap between the casting nozzle and the casting surface from the flow-out direction to a strip removal direction;

freezing the melt essentially by cooling by the moving cooling body;

feeding the melt in the casting nozzle, up to a point of entry into the casting slit, in a feed direction essentially perpendicular to the flow-out direction, the melt being diverted within the casting nozzle adjacent the casting slit from the feed direction to the flow-out direction; and conveying the melt at a velocity not greater than 0.8 meter per second in a section of a tubular body of the casting nozzle which is closed on all sides and upstream of the casting slit.

26. A process according to claim 25 wherein a pressure is applied to the melt during casting, the pressure being calculated under static conditions in a plane of the casting slit and amounting to 0.1–0.5 bar.

27. A process according to claim 25 wherein the melt is pressurized by gas pressure from a level of a bath liquid surface below the casting slit into the casting nozzle.

* * * * *